US010316815B2

(12) United States Patent
Li et al.

(10) Patent No.: US 10,316,815 B2
(45) Date of Patent: Jun. 11, 2019

(54) DEVICE HAVING COMMUNICATION WITH SMALL GASOLINE ENGINE IGNITER

(71) Applicant: Zhejiang Fenglong Electrical Machinery Co., Ltd, Shaoxing, Zhejiang (CN)

(72) Inventors: Jiang Li, Zhejiang (CN); Meijun Zheng, Zhenjiang (CN); Bin Zhang, Zhejiang (CN)

(73) Assignee: ZHEJIANG FENGLONG ELECTRICAL MACHINERY CO., LTD, Shaoxing (CN)

( * ) Notice: Subject to any disclaimer, the term of this patent is extended or adjusted under 35 U.S.C. 154(b) by 228 days.

(21) Appl. No.: 15/356,788

(22) Filed: Nov. 21, 2016

(65) Prior Publication Data

US 2017/0067435 A1 Mar. 9, 2017

Related U.S. Application Data

(63) Continuation of application No. PCT/CN2015/075151, filed on Mar. 26, 2015.

(30) Foreign Application Priority Data

Dec. 30, 2014 (CN) ..... 2014 1 0850798

(51) Int. Cl.
*F02P 3/08* (2006.01)
*F02P 9/00* (2006.01)
(Continued)

(52) U.S. Cl.
CPC ..... *F02P 3/08* (2013.01); *F02P 9/005* (2013.01); *F02B 63/02* (2013.01); *F02P 1/00* (2013.01);
(Continued)

(58) Field of Classification Search
USPC ..... 361/253
See application file for complete search history.

(56) References Cited

U.S. PATENT DOCUMENTS 5,315,982 A * 5/1994 Ward ..... H01F 38/12 123/598
2011/0023825 A1* 2/2011 Lei ..... F02P 7/067 123/406.19

FOREIGN PATENT DOCUMENTS

CN 2821190 Y 9/2006
CN 101201037 A 6/2008
(Continued)

OTHER PUBLICATIONS

International Search Report of PCT Patent Application No. PCT/CN2015/075151 dated Jul. 22, 2015.
(Continued)

*Primary Examiner* — Danny Nguyen

(57) ABSTRACT

The present invention discloses a device having communication with small gasoline engine igniter, comprising an igniter, a flameout switch and a communication device, and both the flameout switch and the communication device are connected to an igniter flameout port and an iron core of a reference ground. The unique voltage conversion circuit herein makes the signals at MUC sampling port more close to the required theoretical value, to ensure more stable and reliable communications. The design of key input and data display enables the communication device to be used alone without additional computers or other additional equipments, simple and convenient. On the basis of above igniter program, very simple circuit at extremely low costs is added, together with the MCU control program, the invention can have a single-wire bidirectional communication with an
(Continued)

external device, so as to achieve operations of controlling MCU internal data of the igniter.

8 Claims, 3 Drawing Sheets

(51) Int. Cl.

| | |
|---|---|
| *F02P 3/05* | (2006.01) |
| *F02P 3/01* | (2006.01) |
| *F02B 63/02* | (2006.01) |
| *F02P 1/00* | (2006.01) |
| *F02P 1/08* | (2006.01) |

(52) U.S. Cl.
CPC . *F02P 1/08* (2013.01); *F02P 3/01* (2013.01); *F02P 3/051* (2013.01); *F02P 9/007* (2013.01)

(56) References Cited

FOREIGN PATENT DOCUMENTS

| | | |
|---|---|---|
| CN | 102930613 A | 2/2013 |
| CN | 204386787 U | 6/2015 |

OTHER PUBLICATIONS

1st Office Action of counterpart Chinese Patent Application No. 201410850798.9 dated Jan. 5, 2016.

* cited by examiner

DEVICE HAVING COMMUNICATION WITH SMALL GASOLINE ENGINE IGNITER

CROSS-REFERENCE TO RELATED APPLICATIONS

This present application is a Continuation Application of PCT application No. PCT/CN2015/075151 filed on Mar. 26, 2015, which claims priority to Chinese Patent Application No. 201410850798.9 filed on Dec. 30, 2014, the contents of which are hereby incorporated by reference.

FIELD OF THE INVENTION

The present invention relates to a small gasoline engine igniter, which is applied to small gasoline internal combustion engines, such as mowers, brush cutters, hedge trimmers, chain saws in the garden tool field, and in particular, to a device having communication with small gasoline engine igniter.

BACKGROUND OF THE INVENTION

The traditional small digital igniters for gasoline engines adopt MCU as the core control unit, to provide appropriate ignition signals for the normal operation of a gasoline engine. It can identify the shutdown signals through a flameout port connected to an external flameout switch, to stop a running engine. However, it needs external interfaces to achieve operations of controlling MCU internal data of the igniter, such as reading, modifying, etc., and the circuit is very complicated.

SUMMARY OF THE INVENTION

Specific to the above technical problems, the present invention discloses a device having communication with small gasoline engine igniter to achieve single-wire bidirectional communication with the igniters of a small gasoline engine.

In order to solve the above technical problems, the invention adopts the following technical solutions:

A device having communication with small gasoline engine igniter, comprising an igniter, a flameout switch and a communication device, and both the flameout switch and the communication device are connected to an igniter flameout port and an iron core of a reference ground.

Further, the igniter comprises an igniter MCU control chip circuit, an igniter data input circuit connected to the data input terminal P3 of igniter MCU control chip circuit, an igniter data output circuit connected to the data output terminal P4 of igniter MCU control chip circuit, and an igniter charging and energy storage circuit that supplies power for the igniter MCU control chip circuit, igniter data input circuit and igniter data output circuit.

Further, the communication device comprises a central control circuit of communication device, a control data receiving circuit connected to a data receiving terminal P7 of central control circuit of communication device, and a control data output circuit connected to a data transmitting terminal P8 of central control circuit of communication device.

Further, the igniter charging and energy storage circuit comprises a resistor R21, a capacitor C21, a diode D22 and a diode D21, an external power supply is connected to one end of the resistor R21, capacitor C21 and the negative end of the diode D22, and another end of resistor R21 is connected to the negative end of the diode D22 and the power source end of MCU control chip, another end of capacitor C21 and the positive end of diode D21 are grounded, and the positive end of diode D22 is connected to a flameout port.

Further, the igniter data input circuit comprises a resistor R22, a capacitor C22 and a diode D23, one end of resistor R22 is connected to the power source end of MCU control chip, another end of resistor R22 is connected to data input terminal P3 of MCU control chip, one end of capacitor C22 is connected to the positive end of diode D23, and another end of capacitor C22 is grounded, and the negative end of diode D23 is connected to a flameout port.

Further, the igniter data output circuit comprises a resistor R23, a resistor R24, a transistor Q21, the data output terminal P4 of igniter MCU control chip circuit is connected to one end of resistor R23 and resistor R24, another end of resistor R23 is connected to a base of transistor Q21, another end of resistor R24 is connected to an emitter of transistor Q21, the emitter of transistor Q21 is grounded and a collector is connected to a flameout port.

Further, comprising a power circuit, a voltage regulator circuit, a display circuit and a keying circuit, wherein the power circuit is connected to the voltage regulator circuit to supply power for the central control circuit of communication device, and the display circuit and the keying circuit are connected to and controlled by the central control circuit of communication device.

Further, the control data receiving circuit comprises a resistor R32, a diode D31 and a capacitor C31, the data receiving terminal P7 of central control circuit of communication device is connected to an end of resistor R32, the positive end of diode D31 and one end of capacitor C31, another end of capacitor C31 is grounded, another end of resistor R32 is connected to the output end of the voltage regulator circuit, the negative end of diode D31 is connected to a flameout port, and the power circuit is connected to the flameout port after passing through resistor R31.

Further, the control data output circuit comprises a resistor R33, a resistor R34 and a transistor, the data transmitting terminal P8 of central control circuit of communication device is connected to one end of resistor R33, resistor R34, another end of resistor R33 is connected to a base of the transistor, another end of resistor R34 is connected to an emitter of the transistor, and the emitter of the transistor is grounded, and a collector of the transistor is connected to a flameout port.

The invention can achieve the following beneficial effects: compared to traditional circuits, the present invention designs a different circuit to achieve data communications. The unique voltage conversion circuit herein makes the signals at MUC sampling port more close to the required theoretical value, to ensure more stable and reliable communications. The design of key input and data display enables the communication device to be used alone without additional computers or other additional equipments, simple and convenient. On the basis of above igniter program, very simple circuit at extremely low costs is added, together with the MCU control program, the invention can have a single-wire bidirectional communication with an external device, so as to achieve operations of controlling MCU internal data of the igniter, such as reading, modifying, etc.

DETAILED DESCRIPTION OF THE EMBODIMENTS

The invention is further described in combination with drawings and specific embodiments.

The present invention designs a device having communication with small gasoline engine igniter, which can achieve single-wire bidirectional data communication with a small gasoline engine igniter. The igniter uses a MCU as the control center, providing ignition signals for the working of engine. The igniter has a flameout port and the reference ground wire, which are connected to an external flameout switch, to achieve the flameout shutdown of an engine. The igniter has two working power supplies: a. an alternating magnetic field generated by flywheel rotations on the surface closest to igniter core embedded with magnetic steels, making the coils inside the igniter to generate an induced voltage; or b. an external power supply that is connected to the igniter through the flameout port and the reference ground wire.

The igniter comprises an igniter data input circuit, igniter data output circuit and external power receiving circuit. The igniter data input circuit, igniter data output circuit and external power receiving circuit are all connected to the flameout port. The communication device comprises a power circuit, which may be a battery, a power adapter, or a power circuit that can generate a stable DC voltage.

The communication device comprises a control data receiving circuit, a control data output circuit and a power supply circuit. The control data receiving circuit, control data output circuit and power supply circuit has a common connection port. The common connection port is connected to the flameout port of igniter.

The communication device comprises a display circuit, which may be an LCD, an LED, or other display device that can display information, to display the required data.

The communication device comprises a key input circuit, which can achieve the information input of communication device by human.

Figure 1:
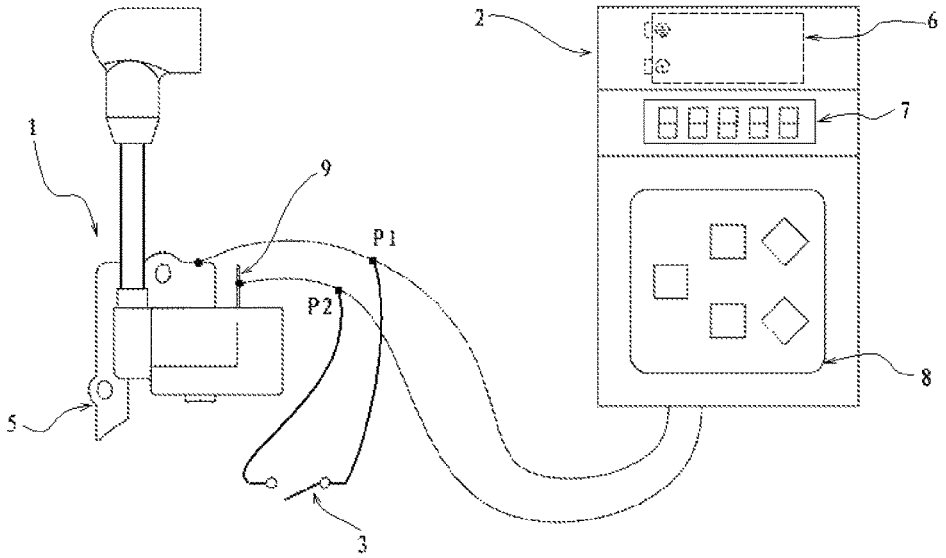
FIG. 1 is a schematic diagram of the invention.
Figure 2:
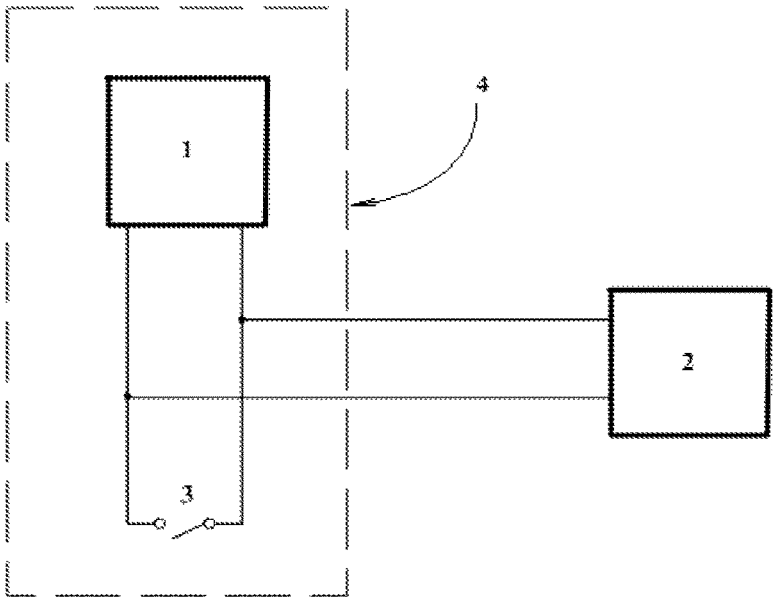
FIG. 2 is a simplified diagram the structure of the invention.

Referring to FIG. 1 and FIG. 2, the small gasoline engine 4 comprises many components, and the components related to the invention are the igniter 1 and flameout switch 3. The two ends of the flameout switch 3 are connected to the flameout port 9 of the igniter 1 and the iron core 5 of the reference ground respectively, to input the shutdown signals to the igniter 1 to control the gasoline engine 4 to stop running. The communication device 2 are connected to the flameout port 9 of the igniter 1 and the iron core 5 of the reference ground through the connecting wire P1 and connecting wire P2, respectively, to achieve single-wire bidirectional data communications with the igniter 1. The communication device 2 comprises the power circuit 8, keying circuit 7 and display circuit 6, and the power circuit 8 can provide energy to all circuits of the communication device 2 and provide energy for the working of igniter 1 through connecting wire P1 and connecting wire P2. Operators can perform parameters and functions setting of the communication device 2 through the keying circuit 7, and then the communication device 2 will visually display the related information through the display circuit 6.

Figure 3:
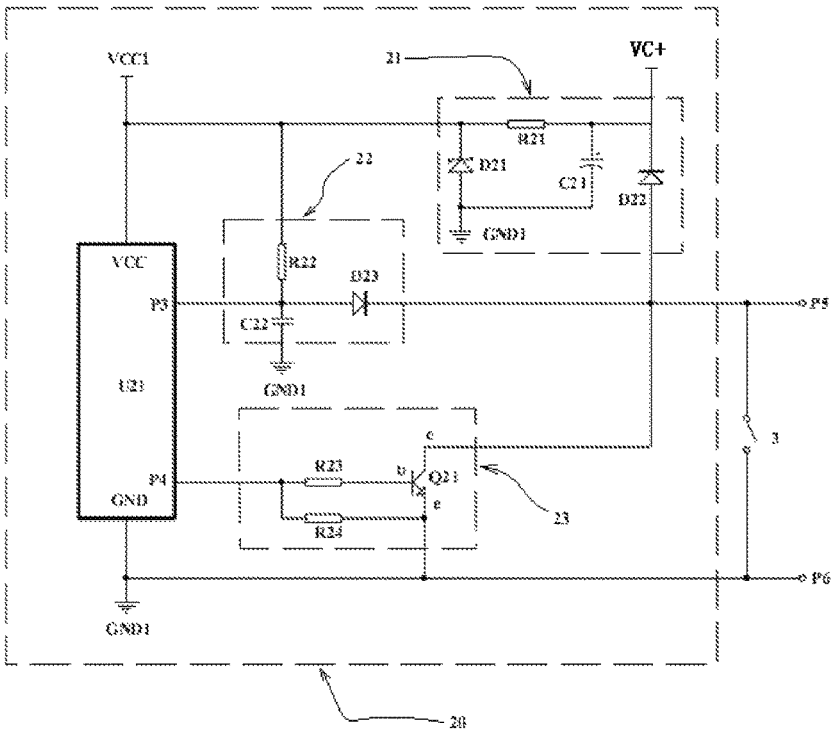
FIG. 3 is a circuit diagram of an igniter in the invention.

FIG. 3 depicts the igniter circuit 20 inside igniter 1 related to internal communication functions, comprising a MUC control chip U21, and its internal storage of data and procedure control igniter 1 to achieve ignition output, flameout sampling and two-way data communications with communication device 2. The connection point P5 is the flameout port 9 in FIG. 1; 3 completely independent functional circuits, working power charging and energy storage circuit 21, igniter data input circuit 22 and igniter data output circuit 23 are connected in the igniter circuit 20. The working power charging and energy storage circuit 21 provides energy for all components in the igniter circuit 20. The positive voltage applied into the connection point P5 can charge the capacitor C21 through the diode D22. The voltage stored on the capacitor C21 is connected to the VCC pin after voltage stabilization through the resistor R21 and the voltage-regulator diode D21, to provide energy for MUC control chip U21. The igniter data input circuit 22 comprises a resistor R22, a capacitor C22 and a diode D23. When the voltage on the connection point P5 is "1", the voltage on the data input terminal P3 is pulled up to VCC1 (also "1") by the resistor R22; when the voltage on the connection point P5 is "0", the voltage on the data input terminal P3 is pulled down to "0" after connected to the connection point P5 through the diode D23. The igniter data output circuit 23 comprises a resistor R23, a resistor R24 and a transistor Q21. When the output of the data output terminal P4 is "1", a high voltage drives the conduction between c pin and e pin of the transistor Q21 through the resistor R23, to make the voltage on the connection point P5 is pulled to almost the same as that of the connection point P6, which is "0"; when the output of the data output terminal P4 is "0", the control electrode b of the transistor Q21 is pulled to GND (i.e. "0") of MUC control chip U21 through resistor R23 and resistor R24, unable to achieve conduction between c and e of the transistor Q21, and the voltage on the connection point P5 is pulled to "1" by the resistor R31.

Figure 4:
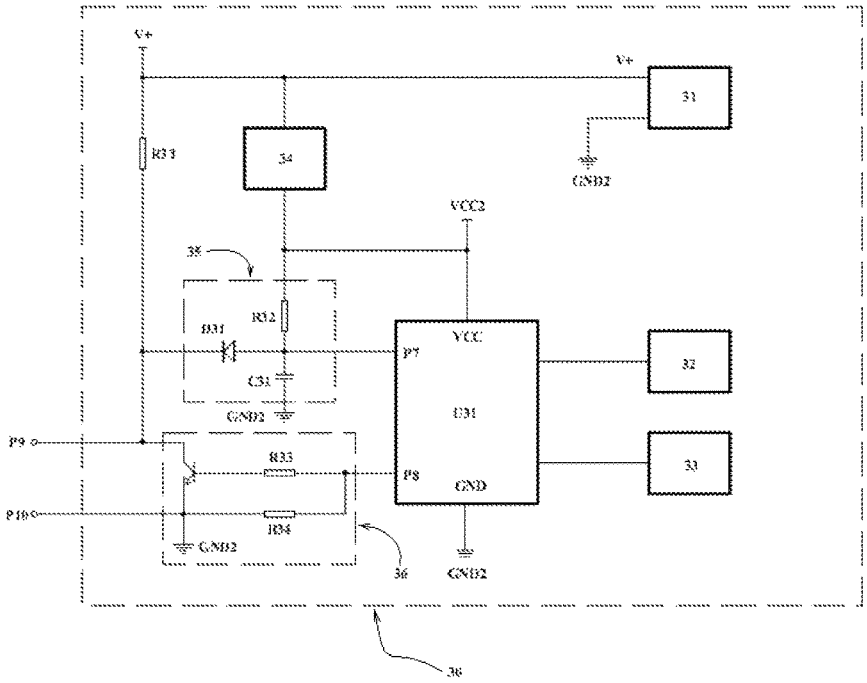
FIG. 4 is a circuit diagram of a communication device in the invention.

FIG. 4 depicts the circuit 30 of the communication device 2, comprising a microprocessor U31, which is a central control unit for controlling the data input and output, information display and key scanning functions. It further comprises a power circuit 31, which forms VCC2 after voltage stabilization through the voltage regulator circuit 34, to provide power supply for the working of microprocessor U31; the power circuit 31 is connected to the connection point P5 after passing the resistor R31, to provide working power supply for the igniter circuit 20. The circuit 30 of communication device 2 comprises a display circuit 32, used to visually display the related information in microprocessor U31 for operator's reading. The circuit 30 of communication device 2 further comprises a keying circuit 33, which may be designed as a key or a combination of many keys, used to allow operators to input data or operational instructions to the microprocessor U31. The control data receiving circuit 35 transmits the voltage signal on the communication line to P7 pin of a microprocessor U31, and the microprocessor U31 can know the received data information by identifying the voltage state on the P7 pin. The working principle of the control data receiving circuit 35 is exactly the same as the igniter data input circuit 22 in the FIG. 3, as illustrated in FIG. 3. The control data output circuit 36 is responsible for transmitting the data that are required to be sent by the microprocessor U31 to the data bus, and then transmitted to MUC control chip U21 through the igniter data input circuit 22 of the igniter circuit 20. The working principle of the control data output circuit 36 is exactly the same as the igniter data output circuit 23 in the FIG. 3, as illustrated in FIG. 3. The connection point P9 is connected to the connection point P5 in FIG. 3, and the connection point P10 in FIG. 3 is connected to connection point P6. When the transistor Q31 in the circuit 30 of the communication device 2 and the transistor Q21 in the igniter circuit 20 are all turned off, voltage V+ can charge the capacitor C21 through the resistor R31, the connection point P9, the connection point P5 and the diode D22, to provide power for the igniter circuit 20.

Figure 5:
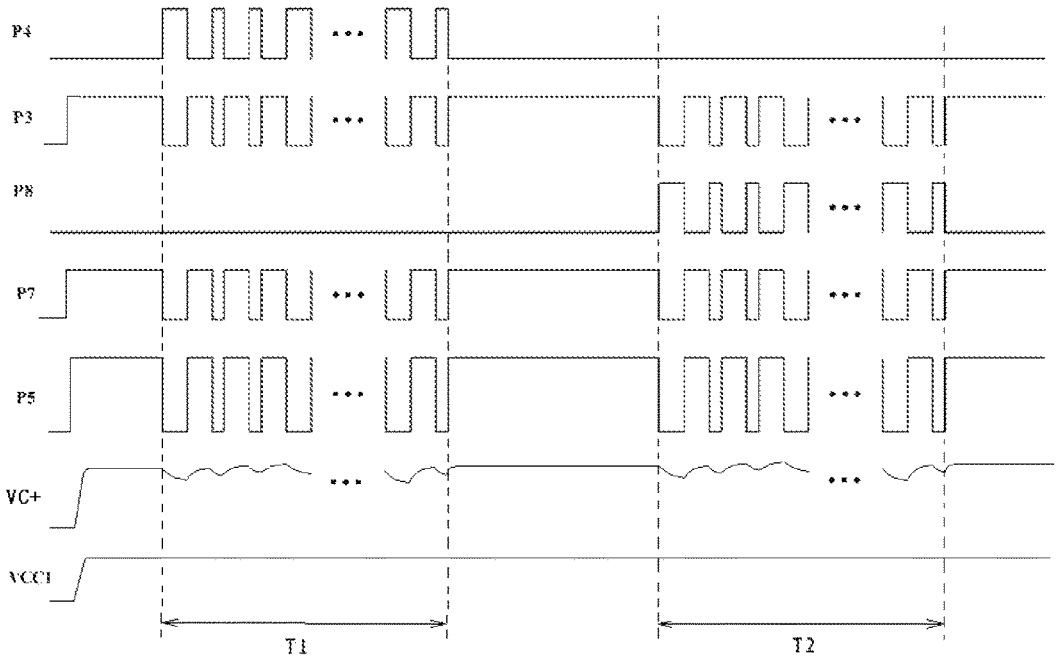
FIG. 5 is a voltage waveform example of main reference points.

FIG. 5 is an example of a voltage waveform of the main reference points. Within the period T1, the data output terminal port P4 of the MUC control chip U21 actively sends data, and the U31 control data receiving data terminal P7 port receives the data sent from the data output terminal P4 of the MUC control chip U21, to achieve the data transmission from igniter 1 to the communication device 2, as shown in FIG. 1. Within the period T2, the central control circuit data transmitting terminal P8 of the microprocessor U31 actively sends data and the data input terminal P3 of the MUC control chip U21 receives the data sent from data transmitting terminal P8 port of the central control circuit, to achieve the data transmission from the communication device 2 to the igniter 1.

The above described are only the preferred embodiments of the present invention, it should be noted that, technicians skilled in the art can make a number of improvements and modifications without departing from the concepts and spirit of the invention, and these improvements and modifications should be considered within the scope of protection of the present invention.

What is claimed is:

1. A device having communication with small gasoline engine igniter, comprising an igniter, a flameout switch and a communication device, and both the flameout switch and the communication device are connected to an igniter flameout port and an iron core of a reference ground; wherein the igniter comprises an igniter MCU control chip circuit, an igniter data input circuit connected to the data input terminal P3 of the igniter MCU control chip circuit, an igniter data output circuit connected to the data output terminal P4 of the igniter MCU control chip circuit, and an igniter charging and energy storage circuit that supplies power for the igniter MCU control chip circuit, the igniter data input circuit and the igniter data output circuit.

2. The device having communication with small gasoline engine igniter according to claim 1, wherein the communication device comprises a central control circuit of communication device, a control data receiving circuit connected to a data receiving terminal P7 of central control circuit of communication device, and a control data output circuit connected to a data transmitting terminal P8 of central control circuit of communication device.

3. The device having communication with small gasoline engine igniter according to claim 2, wherein the igniter charging and energy storage circuit comprises a resistor R21, a capacitor C21, a diode D22 and a diode D21, an external power supply is connected to one end of the resistor R21, capacitor C21 and the negative end of the diode D22, and another end of resistor R21 is connected to the negative end of the diode D22 and the power source end of MCU control chip, another end of capacitor C21 and the positive end of diode D21 are grounded, and the positive end of diode D22 is connected to a flameout port.

4. The device having communication with small gasoline engine igniter according to claim 3, wherein the igniter data input circuit comprises a resistor R22, a capacitor C22 and a diode D23, one end of resistor R22 is connected to the power source end of MCU control chip, another end of resistor R22 is connected to data input terminal P3 of MCU control chip, one end of capacitor C22 is connected to the positive end of diode D23, and another end of capacitor C22 is grounded, and the negative end of diode D23 is connected to a flameout port.

5. The device having communication with small gasoline engine igniter according to claim 4, wherein the igniter data output circuit comprises a resistor R23, a resistor R24, a transistor Q21, the data output terminal P4 of igniter MCU control chip circuit is connected to one end of resistor R23 and resistor R24 , another end of resistor R23 is connected to a base of transistor Q21, another end of resistor R24 is connected to an emitter of transistor Q21, the emitter of transistor Q21 is grounded and a collector is connected to a flameout port.

6. The device having communication with small gasoline engine igniter according to claim 5, further comprising a power circuit, a voltage regulator circuit, a display circuit and a keying circuit, wherein the power circuit is connected to the voltage regulator circuit to supply power for the central control circuit of communication device, and the display circuit and the keying circuit are connected to and controlled by the central control circuit of communication device.

7. The device having communication with small gasoline engine igniter according to claim 6, wherein the control data receiving circuit comprises a resistor R32, a diode D31 and a capacitor C31, the data receiving terminal P7 of central control circuit of communication device is connected to an end of resistor R32, the positive end of diode D31 and one end of capacitor C31, another end of capacitor C31 is grounded, another end of resistor R32 is connected to the output end of the voltage regulator circuit, the negative end of diode D31 is connected to a flameout port, and the power circuit is connected to the flameout port after passing through resistor R31.

8. The device having communication with small gasoline engine igniter according to claim 7, wherein the control data output circuit comprises a resistor R33, a resistor R34 and a transistor, the data transmitting terminal P8 of central control circuit of communication device is connected to one end of resistor R33, resistor R34, another end of resistor R33 is connected to a base of the transistor, another end of resistor R34 is connected to an emitter of the transistor, and the emitter of the transistor is grounded, and a collector of the transistor is connected to a flameout port.

* * * * *